US005518821A

United States Patent [19]

Sakaki et al.

[11] Patent Number: 5,518,821

[45] Date of Patent: May 21, 1996

[54] RECORDING MEDIUM AND INK-JET RECORDING METHOD EMPLOYING THE SAME

[75] Inventors: Mamoru Sakaki, Yamato; Hiromitsu Hirabayashi, Yokohama; Miyuki Fujita, Tokyo; Wataru Ozaku, Sayama; Noboru Fujita, Sayama; Chikara Honzawa, Sayama, all of Japan

[73] Assignees: Canon Kabushiki Kaisha, Tokyo; Dynic Corporation, Kyoto, both of Japan

[21] Appl. No.: 269,362

[22] Filed: Jun. 30, 1994

[30] Foreign Application Priority Data

Jul. 6, 1993 [JP] Japan ..... 5-191642

[51] Int. Cl.[6] ..... B05D 5/04

[52] U.S. Cl. ..... 428/500; 428/195; 428/520

[58] Field of Search ..... 428/195, 500, 428/520; 347/105

[56] References Cited

U.S. PATENT DOCUMENTS

| | | | |
|---|---|---|---|
| 4,478,910 | 10/1984 | Oshima et al. | 428/331 |
| 4,877,680 | 10/1989 | Sakaki et al. | 428/332 |
| 5,241,006 | 8/1993 | Iqbal et al. | 428/475.2 |

FOREIGN PATENT DOCUMENTS

| | | |
|---|---|---|
| 0272125 | 6/1988 | European Pat. Off. . |
| 0380133 | 8/1990 | European Pat. Off. . |
| 0495430 | 7/1992 | European Pat. Off. . |
| 3640359 | 5/1987 | Germany . |
| 54-059936 | 5/1979 | Japan . |
| 60-220750 | 11/1985 | Japan . |
| 3-26665 | 2/1991 | Japan . |
| 3-29596 | 4/1991 | Japan . |
| 3-25352 | 4/1991 | Japan . |

*Primary Examiner*—Pamela R. Schwartz

*Attorney, Agent, or Firm*—Fitzpatrick, Cella, Harper & Scinto

[57] ABSTRACT

A recording medium is provided which comprises a base sheet and an ink-receiving layer on at least one face of the base sheet, the ink-receiving layer containing at least: (i) polyvinyl alcohol or a derivative thereof, (ii) polyalkylene oxide or derivative thereof, and (iii) a hydrophilic acrylic resin composed of a copolymer of a first vinyl monomer having a cationic group with a second vinyl monomer having a hydrophobic group. A recording method is also provided which employs the above recording medium.

11 Claims, 2 Drawing Sheets

RECORDING MEDIUM AND INK-JET RECORDING METHOD EMPLOYING THE SAME

BACKGROUND OF THE INVENTION

1. Field of the Invention

The present invention relates to a recording medium, particularly to an ink-jet recording medium. The present invention also relates to an ink-jet recording method employing the recording medium.

2. Related Background Art

Various recording mediums are used for ink-jet recording, including coated-paper sheets, glossy-paper sheets, OHP-recording films (recording films for overhead projectors), etc. An example of the coated paper is the one disclosed in Japanese Patent Publication No. 3-26665 which comprises a base paper sheet and a coating layer composed of fine powdery silica and a water-soluble binder such as polyvinyl alcohol. An example of the glossy paper is the one disclosed in Japanese Patent Publication No. 3-25352 which comprises a cast-coated paper sheet and a surface layer composed of polyvinyl alcohol of a saponification degree of 50 to 90 mol % and a crosslinking agent. An example of the OHP-recording films is the one which is disclosed in Japanese Patent Application Laid-Open No. 60-220750 which comprises a polyester film and a hydrophilic surface layer composed or a water-soluble polyvinyl alcohol of a saponification degree of 70 to 90 mol %.

With improvements in performance of ink-jet recording apparatuses in recording speed, multiple color recording, and so forth, the recording medium therefor is required to be improved to have the properties below simultaneously:

(1) The recording medium has higher ink-absorbency (a larger ink absorption capacity, and quicker ink absorption).
(2) The recorded dots have high optical density with definite circumference.
(3) The recorded dots have a shape approximate to a true circle with smooth circumference.
(4) The recording medium changes little its properties and does not curl with changes of temperature and humidity.
(5) The recording medium does not cause blocking.
(6) The recorded image is stable and does not deteriorate in long-term storage (particularly under a high temperature and a high humidity).
(7) The recording medium itself is stable and does not deteriorate in long-term storage (particularly under a high temperature and a high humidity).

OHP-recording sheets are additionally required to have excellent transparency.

These required conditions are inconsistent with each other, and prior art technique does not give a recording medium satisfying simultaneously the above required properties. For example, the above-mentioned recording mediums of the prior art, although they are acceptable in the recorded dot shape and anti-blocking properties, do not have sufficient ink absorbency, causing disadvantageously non-fixation of excessive ink, at regions where a larger amount of ink is deposited, to give rise to image disturbance and irregular image density, and in particular in color printing to give muddiness of color at the border of different colors.

With the progress of ink-jet recording in recording speed, recording density, and color printing, deterioration of image quality caused by insufficient ink fixation has become a serious problem.

The recording medium described in Japanese Patent Publication No. 3-29596, which has an ink-receiving layer mainly composed of polyvinylpyrrolidone has relatively high ink absorbency at a normal temperature and a normal humidity, but has disadvantages of low ink-drying speed and liability of blocking at a higher temperature and a higher humidity; and low resistance to scratching owing to low mechanical strength of the recording surface.

The recording mediums having an ink-receiving layer composed mainly of polyvinyl alcohol as mentioned above as the prior art, which are satisfactory in anti-blocking properties and the mechanical strength of the recording face, have disadvantages of deterioration of the recording medium to cause decrease of ink absorbency, and deterioration of an recorded image such as feathering of ink dots and lowering of sharpness of a recorded image during long-term storage at a higher temperature and a higher humidity.

SUMMARY OF THE INVENTION

The present invention intends to provide a recording medium which satisfies the aforementioned requirements simultaneously and consistently, particularly to provide a recording medium which does not deteriorate inherently and does not cause deterioration of recorded images thereon even at a long-term of storage at a high temperature and a high humidity.

The present invention also intends to provide an ink-jet recording method employing the above recording medium.

The recording medium of the present invention comprises a base sheet and an ink-receiving layer on at least one face of the base sheet, the ink-receiving layer containing at least:

(i) polyvinyl alcohol or a derivative thereof,
(ii) polyalkylene oxide or derivative thereof, and
(iii) a hydrophilic acrylic resin composed of a copolymer of a first vinyl monomer having a cationic group with a second vinyl monomer having a hydrophobic group.

The recording method of the present invention employs the above recording medium.

In preferred embodiments of the recording medium of the present invention, the material (ii) is contained at a content of from 2 to 10% by weight in the ink-receiving layer; the material (iii) is contained at a content of from 10 to 40% by weight in the ink-receiving layer; an epoxy compound is contained at a content of not less than 0.5% by weight in the ink-receiving layer; and the base sheet is a plastic film.

DETAILED DESCRIPTION OF THE PREFERRED EMBODIMENTS

Figure 1:
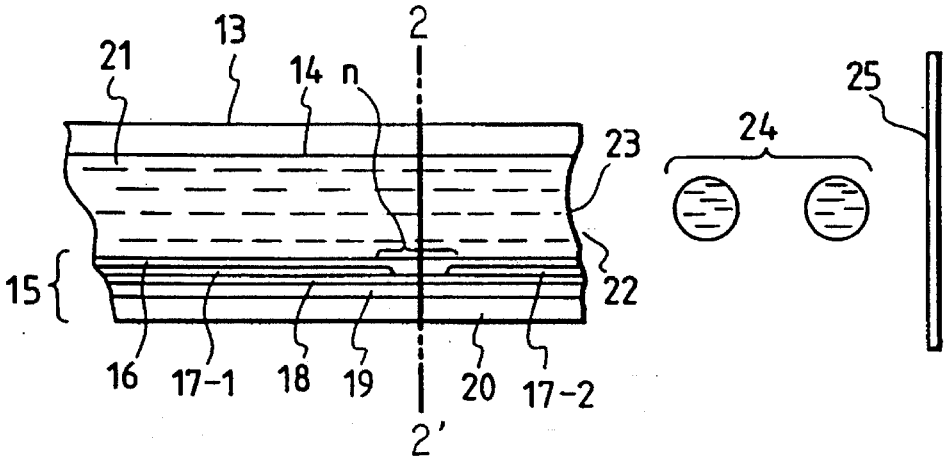
FIG. 1 is a cross-sectional view, along an ink flow path, of a recording head of an ink-jet recording apparatus.

In investigation by the inventors of the present invention for development of novel recording paper for ink-jet recording and transparent films for an overhead projector, the recording medium coated with the above-mentioned composition was found to have extremely high ink absorption capacity to give sharp dots, to have excellent anti-blocking properties, to have the properties depending little on temperature-humidity conditions; to be stable during long-term storage at a high temperature and a high humidity; and to be capable of forming stable images resistant to high temperature and high humidity conditions in long-term storage. The present invention has been accomplished on the basis of the above findings.

The present invention is described in more detail by reference to preferred embodiments.

The polyvinyl alcohol, which is the above first material employed for formation of the ink-receiving layer of the present invention, is prepared by saponification of a vinyl acetate homopolymer with an acid or an alkali to a desired saponification degree. The derivative of the polyvinyl alcohol includes modified polyvinyl alcohols derived by saponification of a copolymer of vinyl acetate with vinyl chloride, ethylene, maleic acid, itaconic acid, acrylic acid, dimethylaminoethyl methacrylate or quaternary derivative thereof, and the like; reaction products produced by reacting polyvinyl alcohol with a compound reactive to the hydroxyl group of the polyvinyl alcohol molecule such as melamine resins, isocyanate compounds, aldehydes, epoxy compounds, boron-containing compounds, and chromium-containing compounds, e.g., polyvinylacetal, polyvinylformal, etc.

The saponification degree of the above polyvinyl alcohol is preferably in the range of from 77 to 99 mol %. Outside this range, the capacity of aqueous ink absorption of the ink-receiving layer is low, and is not preferred.

The polyalkylene oxide, which is the above second material employed for formation of the ink-receiving layer of the present invention, is a polyhydroxy compound derived by addition of ethylene oxide and/or propylene oxide to a compound having two or more active hydrogen groups in the molecule. The compound having two or more active hydrogen groups includes ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine, cyclohexylamine, bisphenol A, glycerin, trimethylolpropane, pentaerythritol, monoethanolamine, diethanolamine, triethanolamine, isopropanolamine, and the like.

The polyalkylene glycol derivative includes reaction products of the above polyhydroxy compounds with a compound reactive thereto. The polyalkyleneglycol derivative has preferably a weight-average molecular weight of not less than 20,000. The one having lower molecular weight exhibits adhesiveness after formation of the ink-receiving layer, and is liable to cause blocking.

Particularly preferred compounds in the present invention are polymers having a weight-average molecular weight of not lower than 20,000 which are derived by reaction of the above polyhydroxy compound having a weight-average molecular weight of 1,000 or more with a polyvalent carboxylic acid, or anhydride thereof, or a lower alkyl ester thereof. The polyvalent carboxylic acid to be reacted with the polyhydroxy compound specifically includes malonic acid, maleic acid, succinic acid, fumaric acid, itaconic acid, phthalic acid, isophthalic acid, terephthalic acid, adipic acid, sebacic acid, dimer acid, pyromellitic acid, trimellitic acid, and so forth. The lower alkyl ester thereof includes monomethyl esters, dimethyl esters, monoethyl esters, diethylesters, monopropyl esters, dipropyl esters, monobutyl esters, dibutyl esters, and the like.

The reaction of the above polyhydroxy compound with the polyvalent carboxylic acid, anhydride, or lower alkyl ester thereof is conducted at a temperature of from 80° to 250° C. at a reduced pressure of from 0.001 to 20 mmHg for 30 minutes to 10 hours for dehydration or alcohol removal (transesterification). If the molecular weight of the polymeric compound is lower than 20000, the obtained ink receiving layer has a lower surface film strength and has insufficient blocking resistance.

Synthesis of the above polymer is specifically described by reference to a synthesis example without limiting the invention.

SYNTHESIS EXAMPLE 1

In an autoclave, were placed 140 parts by weight of glycerin, and 20 parts by weight of potassium hydroxide. Thereto 12,000 parts by weight of ethylene oxide was gradually added to cause reaction at 130° C. The reaction product (intermediate) had a weight-average molecular weight of about 8,000 estimated from the measured hydroxyl value and the measured alkali value.

To 100 parts of the reaction product, 2 parts of dimethyl terephthalate was added. The mixture was heated to 125° C., and the pressure was reduced to 1 mmHg to remove methanol. The obtained polymer had a weight-average molecular weight of about 150,000 according to high speed liquid chromatography.

The hydrophilic acrylic resin, which is a copolymer of a vinyl monomer having a cationic group with another vinyl monomer having a hydrophobic group, and is the third material for the ink-receiving layer, is formed by copolymerization of at least one monomer selected for the monomers having a cationic group with at least one other monomer selected for the monomers having a hydrophobic group.

The monomer having a cationic group includes dimethylaminoethyl acrylate, dimethylaminoethyl methacrylate, diethylaminoethyl methacrylate, methylethylaminoethyl acrylate, methylethylaminoethyl acrylate, dimethylaminostyrene, diethylaminostyrene, methylethylaminostyrene, and quaternary compounds thereof, which have a primary to tertiary amine group or a quaternary ammonium base group as a pendant group.

The monomer having a hydrophobic group includes alkyl acrylates such as methyl acrylate, and ethyl acrylate; alkyl methacrylate such as methyl methacrylate, and ethyl methacrylate; styrene, vinyltoluene, vinyl acetate, ethylene, and the like. The molar ratio of the comonomers in the copolymer is preferably in the range of from 1/9 to 9/1. Additionally other hydrophilic monomer such as 2-hydroxyethyl acrylate, and 2-hydroxyethyl methacrylate may be copolymerized into the copolymer, as desired.

In the present invention, the composition containing at least the above three materials for formation of the ink-receiving layer may further contain an epoxy compound at a content of 0.5% by weight or more, preferably in the range of from 0.5 to 5% by weight to improve the mechanical strength of the recording surface.

The epoxy compound includes specifically ethylene glycol diglycidyl ether, polyethylene glycol diglycidyl ether, propylene glycol diglycidyl ether, polypropylene glycol diglycidyl ether, neopentyl alcohol diglycidyl ether, glycerol polyglycidyl ether, trimethylol propane polyglycidyl ether, diglycerol polyglycidyl ether, and the like.

As described above, formation of an ink-receiving layer containing at least the above three materials on at least one face of a base sheet satisfies the aforementioned requirements simultaneously and consistently, and particularly gives a recording medium which does not deteriorate inherently and prevents effectively deterioration of a recorded image even at a long-term of storage at a high temperature and a high humidity. Such effects are achieved by synergistic action of the above three materials.

The aforementioned material (ii) is preferably contained in the ink receiving layer at a content of from 2 to 10% by weight. At a lower content thereof, the ink-absorbing capacity of the ink-receiving layer is insufficient, and in particular, deterioration of the recording medium (drop of ink absorbency) is liable to occur during long-term of storage at a high temperature and a high humidity. At a higher content, deterioration of the recorded image (feathering of dots and lowering of sharpness of the image) is liable to occur even with combined use of the material (iii) during long-term storage of the recorded image at a high temperature and a high humidity.

Since the material (i) and the material (ii) are less compatible with each other, the film of the mixture causes phase separation during storage to become turbid. In the present invention, however, the material (iii) is additionally combined to improve the compatibility. This enables formation of an ink-receiving layer which is excellent in transparency and is useful for an OHP-recording sheet.

For this purpose, the content of the material (iii) is preferably higher than that of the material (ii) at least. The material (iii) in the present invention is preferably contained at a content ranging from 10 to 40% by weight in the ink-receiving layer. At the content lower than the above range, the ink absorbency is not sufficient and running of a recorded image is liable to occur during storage at a high temperature and a high humidity, disadvantageously, even if the material (ii) is contained at the abovementioned content range. At the content higher than the above range, a recorded image is nonuniform, disadvantageously.

The composition containing the above three components at least is applied at least one face of a base sheet to form a recording medium having an ink-receiving surface layer in the present invention. The composition may contain another binder, a filler, and an additive in amounts not to prevent the object of the present invention.

The additional binder includes known binders such as starch, cationic starch, casein, gelatin, acrylic resins, maleic anhydride resins, melamine resins, urea resins, SBR latexes, sodium alginate, polyvinylpyrrolidone, carboxymethylcellulose, hydroxyethylcellulose, and the like, but is not limited thereto.

The filler includes silica, alumina, aluminum silicate, magnesium silicate, basic magnesium carbonate, talc, clay, hydrotalcite, calcium carbonate, titanium oxide, zinc oxide, and plastic pigment such as polyethylene, polystyrene, and polyacrylate; but is not limited thereto.

The additional additive includes surface active agents, dye fixing agents (water-proofing agents), antifoaming agents, antioxidants, fluorescent whiteners, UV-absorbing agents, dispersants, viscosity-controlling agents, pH-controlling agents, mildew-proofing agents, and plasticizers. These additives are selected as desired from known additives to meet the objects.

The base sheet material for constituting the recording medium of the present invention includes sheets of paper such as wood free paper, medium-quality paper, art paper, bond paper, regenerated paper, baryta paper, cast-coated paper, and linerboard paper; films and plates of plastic such as polyethylene terephthalate, cellulose diacetate, cellulose triacetate, cellophane, celluloid, polycarbonates, polyimides, polyvinyl chloride, polyvinylidene chloride, polyacrylates, polyethylene, and polypropylene; glass plates; sheets of cloth such as cotton, rayon, acrylics, nylon, silk, and polyesters. The base sheet material is selected suitably from the above materials to meet the object of the recording medium, the use of the recorded image, adhesion with the overlaid ink-receiving layer, and other conditions.

To prepare the recording medium of the present invention, firstly, the aforementioned composition and optional additive are dissolved or dispersed in water, alcohol, or other suitable solvent to prepare the coating liquid.

The obtained coating liquid is applied onto a surface of a base sheet by roll coating, blade coating, air-knife coating, gate-roll coating, size pressing, spray coating, gravure coating, curtain coating, etc. Thereafter, the applied matter is dried by means of a hot-air dryer, a hot drum, or the like to obtain the recording medium of the present invention. The resulting recording medium may be subjected to supercalender treatment to smoothen the surface or to improve the surface strength, if necessary.

The total amount of the ink-receiving layer coating ranges preferably from 0.2 to 50 g/m$^2$, more preferably from 1 to 30 g/m$^2$ in terms of the solid matter. At the smaller amount of coating, a part of the base sheet surface may be bared. At the coating amount of less than 0.2 g/m$^2$, no effect is obtained in dye color development in comparison with the base sheet without the ink-receiving layer. On the other hand, at the coating amount of larger than 50 g/m$^2$, the recording medium curls remarkably under the environmental conditions of low temperature and low humidity, disadvantageously. The coating amount in thickness is preferably in the range of from 0.5 to 100 μm.

Known ink may be useful for ink-jet recording on the above-described recording medium without difficulty The preferred method of recording with ink on the above recording medium is ink-jet recording. Any ink-jet recording method is applicable which ejects ink effectively from a nozzle to apply ink onto the recording medium.

An example of the effective ink-jet recording method is disclosed in Japanese Patent Application Laid-Open No. 54-59936, in which thermal energy is given to the ink to cause abrupt change of the volume of the ink and to eject ink from a nozzle.

An example of ink-jet recording apparatus is described below which is suitable for recording on the recording medium of the present invention.

Figure 2:
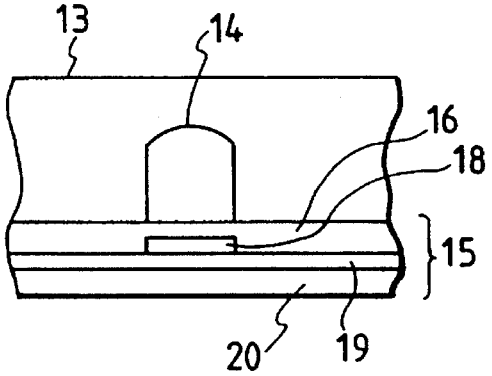
FIG. 2 is a cross-sectional view, perpendicular to an ink flow path, of a recording head of an ink-jet recording apparatus.
Figure 3:
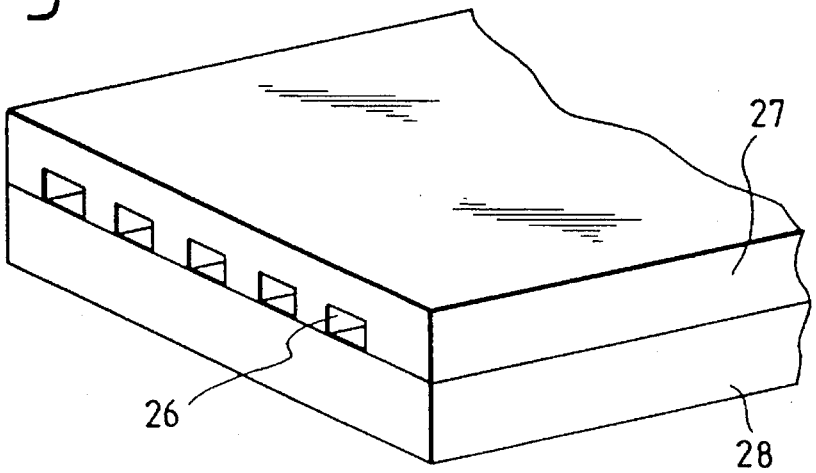
FIG. 3 is a perspective external view of a multiple head employing a plurality of heads shown in FIG. 1.

An example of the construction of a head which is the essential part of the apparatus is shown in FIGS. 1, 2, and 3.

A head 13 is constructed by bonding a plate of glass, ceramics, or plastics having grooves 14 for ink flow with a heat-generating head 15 for thermal recording. (The heat-generating head is not limited to the thin film head shown in the drawings.) The heat-generating head 15 is constituted of a protection layer 16 formed from silicon oxide or the like; aluminum electrodes 17-1, 17-2; a heat-generating resistance layer 18 made of nichrome or the like; a heat-accumulating layer 19; and a heat-radiating substrate plate 20 made of alumina or the like.

The ink 21 fills an ejection orifice (fine nozzle) 22, and has a meniscus 23 formed by a pressure P.

On application of an electric signal information to the electrodes 17-1, 17-2 of the head, the region denoted by a symbol "n" on the heat-generating head 15 generates heat abruptly to form bubbles in the ink 21 on that region, the pressure of the bubble pushes out the meniscus 23 to eject the ink 21 from the orifice 22 in a shape of droplets 24. The ejected ink droplets travel toward a recording medium 25.

FIG. 3 shows a external appearance of a multiple head having a plurality of heads shown in FIG. 1. The multiple head is formed by bonding a glass plate 27 having multiple grooves 26 with the heat-generating head 28 like the one shown in FIG. 1. FIG. 1 is a sectional view of the head 13 along the ink flow path, and FIG. 2 is a sectional view taken at the line 2—2' in FIG. 1.

Figure 4:
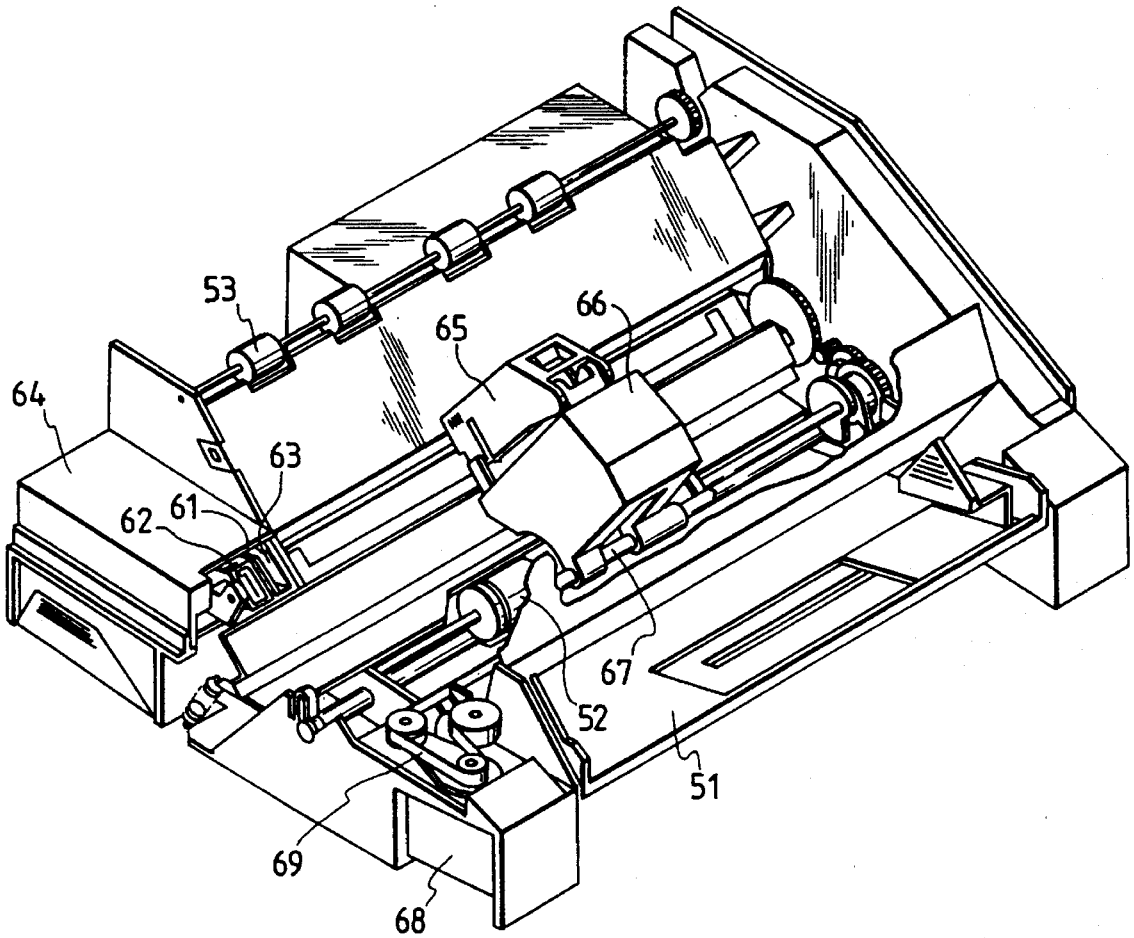
FIG. 4 shows an example of an ink-jet recording apparatus.

FIG. 4 shows an example of the ink-jet recording apparatus equipped with the above-described head.

In FIG. 4, a blade 61 as a wiping member is held at one end of the blade by a blade-holding member, forming a fixed end in a shape of a cantilever. The blade 61 is placed at a position adjacent to the recording region of the recording head, and, in this example, is held so as to protrude into the moving path of the recording head. The cap 62 is placed at a home position adjacent to the blade 61, and is constituted such that it moves in the direction perpendicular to the moving direction of the recording head to come into contact with the ejection nozzle face to cap the nozzle. An ink absorbent 63 is placed at a position adjacent to the blade 61, and is held so as to protrude into the moving path of the recording head in a manner similar to that of the blade 61.

The blade 61, the cap 62, and the absorbent 63 constitute an ejection recovery device 64. The blade 61, and the absorbent 63 serve to remove off water, dust, and the like from the face of the ink ejection nozzle.

A recording head 65 has an energy-generating means for the ejection, and conducts recording by ejecting the ink onto a recording medium opposing to the ejection nozzle face. A carriage 66 is provided for supporting and moving the recording head 65. The carriage 66 is engaged slidably with a guide rod 67. A portion of the carriage 66 is connected (not shown in the drawing) to a belt 69 driven by a motor 68, so that the carriage 66 is movable along the guide rod 67 to the recording region of the recording head 65 and the adjacent region thereto.

A paper delivery device 51 for delivery of a recording medium and a paper delivery roller 52 driven by a motor (not shown in the drawing) delivers a recording medium to the position opposing to the ejection nozzle face of the recording head, and the recording medium is delivered with the progress of the recording to a paper discharge device provided with paper-discharging rollers 53.

In the above constitution, when the recording head 65 returns to the home position on completion of recording, the cap 62 of the ejection-recovery device 64 is positioned out of the moving path of the recording head 65, and the blade 61 is allowed to protrude to the moving path. Thereby, the ejecting nozzle face of the recording head 65 is wiped. To cap the ejection face of the recording head 65, the cap 62 protrudes toward the moving path of the recording head to come into contact with the ejection nozzle face.

When the recording head 65 is made to move from the home position to the record-starting position, the cap 62 and the blade 61 are at the same position as in the above-mentioned wiping step, so that the ejection nozzle face of the recording head 65 is wiped also in this movement. The recording head is moved to the home position not only at the completion of the recording and at the time of ejection recovery, but is also moved at a predetermined intervals during recording from the recording region. The nozzle is wiped by such movement.

The present invention is described more specifically by reference to Examples and Comparative Examples. In the description, the units "parts" and "%" are based on weight unless otherwise mentioned.

EXAMPLES 1–7 AND COMPARATIVE EXAMPLES 1 AND 2

A mixture of (i) polyvinyl alcohol ("SMR-10H", produced by Shin-Etsu Chemical Co., Ltd.); (ii) the polymer obtained in Synthesis Example 1; and (iii) a hydrophilic acrylic resin ("Jurymer SP-50", produced by Nihon Junyaku Co., Ltd., a copolymer of methyl methacrylate with an acrylic quaternary ammonium salt) was added gradually with stirring into a mixed solvent composed of 93 parts of water and 7 parts of isopropyl alcohol, and was dissolved therein. The mixing ratios of the materials (i), (ii), and (iii) are shown in Table 1.

The obtained coating liquid was applied onto a polyethylene terephthalate film (100 μm thick; "Lumirror", produced by Toray Industries, Inc.) by use of a wire bar in a dry thickness of 20 μm. The applied matter was dried at 100° C. for 10 minutes to provide a recording medium of the present invention or for comparison. Color recording was conducted on the recording medium with the inks having the composition below by an ink-jet recording apparatus which ejects inks by bubbling of the ink by thermal energy.

| | |
|---|---|
| [Composition of inks] | |
| Dye | 4 parts |
| Glycerin | 7 parts |
| Thiodiglycol | 10 parts |
| Urea | 5 parts |
| Water | 74 parts |
| [Dye] | |
| Y: C. I. Direct Yellow #86 | |
| M: C. I. Acid Red #23 | |
| C: C. I. Direct Blue #199 | |
| Bk: C. I. Food Black #2 | |
| [Recording conditions] | |
| Ejection frequency | 4 KHz |
| Volume of ejected droplet: | 45 pl |
| Recording density: | 360 DPI |
| Maximum application of single color ink: | 8 nl/mm$^2$ |

The obtained color print sample was evaluated regarding the items below.

[Evaluation items]

(1) Ink absorbency:

Full dot recording was conducted by printing with combinations of two color-inks of yellow, cyan, and magenta under environmental conditions of 30° C. and 80% humidity, and the recorded matter was left standing. The time required for absorption of ink into the ink-receiving layer was checked by finger touch to examine the transfer of the ink onto the finger. The recording medium which caused no transfer of ink to the finger after 10 minutes was evaluated to be "Good"; the one caused no ink transfer after 20 minutes was evaluated to be "Fair": and the one caused ink transfer after 20 minutes was evaluated to be "Poor".

(2) Anti-blocking properties:

Full dot recording was conducted with combinations of two color inks of yellow, cyan, and magenta, and the recorded matter was left standing under environmental conditions of 30° C., and 80% humidity. After 30 minutes, a PPC paper sheet was put on the recorded face of the recording medium and then the recording medium together with the PPC paper sheet was enclosed in a "Clear Pocket File" (the pocket being made of polypropylene film, produced by Lion K.K.). The recorded image in this state was pressed at a pressure of 40 g/cm$^2$. Thereafter the PPC paper sheet was separated from the recording medium. The recording medium which was readily separable was evaluated to be "Good"; the one which was not separable, or causes transfer of the ink-receiving layer to the PPC paper sheet, or a part of the PPC paper remained sticking was evaluated to be "Poor"; and the one in an intermediate state was evaluated to be "Fair".

(3) Image density:

Solid printing was conducted at 200% duty with the aforementioned ink-jet recording apparatus. The black (Bk) image density of the printed matter was measured by MacBeth densitometer (Model: RD-918).

(4) Storability of the recording medium:

The recording medium was stored at 35° C. and 90% humidity for 7 days, then at 23° C. and 55% humidity for one day. Recording was conducted on this recording medium at 23° C. and 55% humidity with the aforementioned apparatus, and the image quality was compared with the one before the storage treatment. The recording medium which gave significantly poor image quality with ink running, feathering, of letter-bolding was evaluated to be "Poor"; the one exhibiting no change was evaluated to be "Good"; the one in an intermediate state was evaluated to be "Fair"; and the one exhibiting lowering of the image quality or causing white turbidity of the film in addition to the lowering of ink absorbency was evaluated to be "Very poor".

(5) Uniformity of image:

The solid-printed matter with the aforementioned printer was evaluated visually. The printed matter which was entirely uniform was evaluated to be "Good"; the one in which nonuniformity was found by visual observation at the distance of 50 cm from the printed matter was evaluated to be "Poor"; and the one in an intermediate state was evaluated to be "Fair".

(6) Storability of recorded image:

The image recorded on the recording medium by the aforementioned printer was stored at 35° C. and 90% humidity for 7 days, and the image quality was compared with the one before the storage. The recording medium which caused significant deterioration of image quality with ink running, feathering, of letter-bolding in comparison with the one before the storage was evaluated to be "Poor"; the one exhibiting no change was evaluated to be "Good"; the one in an intermediate state was evaluated to be "Fair".

Table 2 shows the above evaluation results collectively.

EXAMPLES 8 AND 9

Recording mediums of the present invention were prepared in the same manner as in Example 1 except that partially saponified polyvinyl alcohol ("PVA-217", produced by Kuraray Co. Ltd.), or cation-modified polyvinyl alcohol ("PVA-C-318-2A", produced by Kuraray Co., Ltd.) was used as the polyvinyl alcohol (i).

EXAMPLE 10

A recording medium of the present invention was prepared in the same manner as in Example 1 except that polyethylene oxide ("Alkox R-40", produced by Meisei Chemical Works, Ltd.) was used as the polyalkylene glycol (ii).

COMPARATIVE EXAMPLE 3

A recording medium for comparison was prepared in the same manner as in Comparative Example 1 except that partially saponified polyvinyl alcohol ("PVA-217", produced by Kuraray Co. Ltd.) was used as the polyvinyl alcohol (i).

COMPARATIVE EXAMPLE 4

A recording medium for comparison was prepared in the same manner as in Comparative Example 1 except that polyvinylpyrrolidone ("PVP-K-90", GAF) was used in place of the polyvinyl alcohol (i).

EXAMPLES 11 AND 12

Recording mediums were prepared in the same manner as in Example 2 except that an art paper sheet and a wood-free paper sheet were respectively used as the base sheet.

The evaluation results are shown collectively in Table 2.

As described above, the present invention provides an ideal recording medium which has excellent ink absorbency to enable formation of fine image with sharp printed dots and high optical density, and exhibits no deterioration of both the recording medium and the recorded image formed thereon after long-term storage at high temperature and high humidity. The present invention also provides an ink-jet recording method employing the above recording medium.

TABLE 1

| | (i) | (ii) | (iii) |
|---|---|---|---|
| Example 1 | 70 | 5 | 25 |
| Example 2 | 65 | 10 | 25 |
| Example 3 | 60 | 15 | 25 |
| Example 4 | 70 | 10 | 20 |
| Example 5 | 80 | 5 | 15 |
| Example 6 | 85 | 10 | 5 |
| Example 7 | 45 | 5 | 50 |
| Compartive example 1 | 100 | 0 | 0 |
| Comparative example 2 | 90 | 10 | 0 |

TABLE 2

| | Evaluation Results | | | | | | |
|---|---|---|---|---|---|---|---|
| | (1) Ink absorbency | (2) Anti-blocking property | (3) Image density | (4) Recording medium storability | (5) Image uniformity | (6) Image storability | Remark |
| Example | | | | | | | |
| 1 | Good | Good | 1.50 | Good | Good | Good | |
| 2 | Good | Good | 1.52 | Good | Good | Good | |
| 3 | Good | Good | 1.55 | Good | Good | Fair | |
| 4 | Good | Good | 1.52 | Good | Good | Good | |
| 5 | Good | Good | 1.48 | Good | Good | Good | |
| 6 | Fair | Good | 1.55 | Fair | Good | Fair | Film became slightly white turbid in Example 6 |
| 7 | Good | Good | 1.45 | Good | Fair | Good | |
| 8 | Good | Good | 1.49 | Good | Good | Good | |
| 9 | Good | Good | 1.51 | Good | Good | Good | |
| 10 | Good | Fair | 1.52 | Good | Good | Fair | |
| 11 | Good | Good | — | Good | Good | Good | |
| 12 | Good | Good | — | Good | Good | Fair | |
| Comparative Example | | | | | | | |
| 1 | Fair | Fair | 1.32 | Poor | Poor | Poor | |
| 2 | Good | Fair | 1.33 | Very poor | Good | Poor | Films became remarkably white turbid in Comparative Example 2 |
| 3 | Poor | Fair | 1.29 | Poor | Poor | Poor | |
| 4 | Poor | Poor | 1.41 | Fair | Good | Fair | |

What is claimed is:

1. A recording medium, comprising a base sheet and an ink-receiving layer on at least one face of the base sheet, the ink-receiving layer containing at least:

(i) polyvinyl alcohol or a derivative thereof, (ii) polyalkylene oxide or derivative thereof, and (iii) a hydrophilic acrylic resin composed of a copolymer of at least one first vinyl monomer having a cationic group with at least one second vinyl monomer having a hydrophobic group.

2. The recording medium according to claim 1, wherein the polyalkylene oxide or the derivative thereof is contained in the ink receiving layer at a content ranging from 2 to 10% by weight.

3. The recording medium according to claim 1, wherein the hydrophilic acrylic resin composed of a copolymer of at least one first vinyl monomer having a cationic group with at least one second vinyl monomer having a hydrophobic group is contained in the ink-receiving layer at least at a larger content than the polyalkylene oxide or the derivative thereof.

4. The recording medium according to claim 1, wherein the hydrophilic acrylic resin composed of a copolymer of at least one first vinyl monomer having a cationic group with at least one second vinyl monomer having a hydrophobic group is contained in the ink-receiving layer at a content ranging from 10 to 40% by weight.

5. The recording medium according to any one of claims 1 to 4, wherein the base sheet is a plastic film.

6. The recording medium according to claim 1, wherein polyvinyl alcohol has a saponification degree of 77 to 99 mol %.

7. The recording medium according to claim 1, wherein the polyalkylene oxide is a polyhydroxy compound derived by addition of ethylene oxide or propylene oxide to a compound having two or more active hydrogen groups in a molecule.

8. The recording medium according to claim 7, wherein the compound having two or more active hydrogen groups is selected from the group consisting of ethylene glycol, diethylene glycol, triethylene glycol, propylene glycol, dipropylene glycol, 1,4-butanediol, 1,6-butanediol, 1,6-hexanediol, tetraethylene glycol, polyethylene glycol, polypropylene glycol, propylamine, butylamine, octylamine, cyclohexylamine, bisphenol A, glycerol, trimethylolpropane, pentaerythritol, monoethanolamine, diethanolamine, triethanolamine and isopropanolamine.

9. The recording medium according to claim 1, wherein at least one monomer having a cationic group comprises at least one of dimethylaminoethyl acrylate, dimethylaminoethyl methacrylate, diethylaminoethyl methacrylate, methylethylaminoethyl acrylate, dimethylaminostyrene, diethylaminostyrene, methylethylaminostyrene, and quaternary compounds thereof.

10. The recording medium according to claim 1, wherein at least one monomer having a hydrophobic group comprises at least one of methyl acrylate, ethyl acrylate, methyl methacrylate, ethyl methacrylate, styrene, vinyltolulene, vinyl acetate, and ethylene.

11. The recording medium according to claim 1, wherein the molar ratio of the comonomers in the copolymer is in the range of 1/9 to 9/1.

* * * * *

UNITED STATES PATENT AND TRADEMARK OFFICE

CERTIFICATE OF CORRECTION

PATENT NO. : 5,518,821

DATED : May 21, 1996

INVENTOR(S) : MAMORU SAKAKI, et al.

It is certified that error appears in the above-indentified patent and that said Letters Patent is hereby corrected as shown below:

COLUMN 5

Line 39, "applied" should read --applied to--.

COLUMN 6

Line 36, "difficulty" should read --difficulty.--.

COLUMN 12

Line 46, "wherein" should read --wherein said--;
Line 53, "wherein" should read --wherein said--; and
Line 56, "vinyltolulene," should read --vinyltoluene,--.

Signed and Sealed this

First Day of October, 1996

Bruce Lehman

*Attest:*

BRUCE LEHMAN

*Attesting Officer*

*Commissioner of Patents and Trademarks*